US010960281B2

(12) United States Patent
Lowe

(10) Patent No.: US 10,960,281 B2
(45) Date of Patent: Mar. 30, 2021

(54) TRANSPORTABLE ROWING DEVICE

(71) Applicant: Webster Lowe, Chesapeake City, MD (US)

(72) Inventor: Webster Lowe, Chesapeake City, MD (US)

(73) Assignee: WEBSTER LOWE, Chesapeake City, MD (US)

( * ) Notice: Subject to any disclaimer, the term of this patent is extended or adjusted under 35 U.S.C. 154(b) by 36 days.

(21) Appl. No.: 16/435,649

(22) Filed: Jun. 10, 2019

(65) Prior Publication Data

US 2020/0384333 A1 Dec. 10, 2020

(51) Int. Cl.
*A63B 69/06* (2006.01)

(52) U.S. Cl.
CPC ..... *A63B 69/06* (2013.01)

(58) Field of Classification Search
CPC ..... A63B 69/06; A63B 2069/062–068; A63B 2022/0082; A63B 2022/0084; A63B 22/0076
USPC ..... 440/106
See application file for complete search history.

(56) References Cited

U.S. PATENT DOCUMENTS 1,707,791 A * 4/1929 Anderson ..... A63B 22/0076 482/72
2,374,021 A * 4/1945 Korling ..... 248/411
2,653,000 A * 9/1953 Cadwell ..... F16M 11/16 248/168
2,684,222 A * 7/1954 Miller ..... F16L 3/1218 248/49
3,030,073 A * 4/1962 Rhoads ..... B66F 3/08 254/7 R
3,152,784 A * 10/1964 Robinson ..... F16L 3/00 248/74.1
3,313,505 A * 4/1967 Petrie ..... B25H 1/00 248/165
3,355,035 A * 11/1967 Bennett ..... F17C 13/084 414/769
3,528,653 A * 9/1970 Ross ..... A63B 21/015 482/72
4,068,611 A * 1/1978 Leather ..... B63H 16/06 114/363
4,492,354 A * 1/1985 Rice ..... F16M 11/046 182/182.1
4,699,343 A * 10/1987 Handler ..... B25H 1/06 248/157
4,984,986 A * 1/1991 Vohnout ..... A63B 24/00 434/247
5,165,665 A * 11/1992 Jolivette, Sr. ..... B23Q 3/105 254/98
D348,340 S * 6/1994 Collins, Jr. ..... D34/28
5,421,115 A * 6/1995 McKay ..... F41A 23/12 248/163.1
5,554,088 A * 9/1996 Zlojutro ..... A63B 69/004 482/83
5,819,482 A * 10/1998 Belke ..... E04C 3/005 52/126.6

(Continued)

*Primary Examiner* — Nyca T Nguyen
(74) *Attorney, Agent, or Firm* — Schwegman Lundberg & Woessner, P.A.

(57) ABSTRACT

A transportable rowing device can include a top plate, a rod, and an oar lock. The rod can be rotatable with respect to the top plate. The oar lock can be secured to the rod and the oar lock can be configured to secure an oar therein. The oar lock can be rotatable with the rod.

14 Claims, 8 Drawing Sheets

(56) References Cited

U.S. PATENT DOCUMENTS 5,842,742 A * 12/1998 Hoshino ..... A47C 9/08 297/338
6,066,076 A * 5/2000 Wang ..... A63B 22/0061 482/51
6,106,436 A * 8/2000 Lundahl ..... A63B 21/157 482/1
6,109,988 A * 8/2000 Dunn, Jr. ..... B63H 16/06 440/104
6,796,863 B1 * 9/2004 Oathout ..... B63H 16/06 440/104
7,731,637 B2 * 6/2010 D'Eredita ..... A63B 21/154 482/72
7,744,048 B1 * 6/2010 McKellery ..... F16M 11/242 248/177.1
7,828,706 B2 * 11/2010 Medina ..... A63B 24/00 482/148
7,862,484 B1 * 1/2011 Coffey ..... A63B 21/157 482/72
8,109,859 B2 * 2/2012 Medina ..... A63B 22/0076 482/8
8,425,343 B1 * 4/2013 Olmos ..... A63B 69/3676 473/274
8,646,731 B2 * 2/2014 Burles ..... F16L 3/16 248/49
8,900,075 B2 * 12/2014 Gu ..... A63B 69/0079 473/423
8,950,347 B2 * 2/2015 Radwan ..... B63H 16/10 114/104
9,005,086 B1 * 4/2015 O'Neil ..... A63B 22/0076 482/72
9,486,666 B2 * 11/2016 Singh ..... A63B 22/0087
9,605,773 B1 * 3/2017 Tarapchak ..... F16L 3/1091
9,714,726 B1 * 7/2017 Laidley ..... F16L 3/00
9,833,892 B1 * 12/2017 Gomez ..... B25H 1/04
9,868,042 B1 * 1/2018 Leonard ..... A63B 69/0028
2002/0011548 A1 * 1/2002 Parker ..... F16L 3/1016 248/354.3
2003/0017922 A1 * 1/2003 Sachs ..... A63B 26/003 482/146
2005/0012000 A1 * 1/2005 Jones ..... F16M 11/046 248/178.1
2005/0218275 A1 * 10/2005 Keating ..... F16M 11/10 248/176.1
2006/0264128 A1 * 11/2006 Osten ..... A63B 69/06 440/25
2007/0090237 A1 * 4/2007 Hsu ..... F16M 11/16 248/178.1
2008/0106018 A1 * 5/2008 Bellavance ..... B23K 37/0533 269/57
2008/0280736 A1 * 11/2008 D'Eredita ..... A63B 21/154 482/72
2010/0167606 A1 * 7/2010 Luecker ..... G01K 13/00 440/101
2012/0196726 A1 * 8/2012 Larsson ..... A63B 22/0076 482/72
2015/0111706 A1 * 4/2015 Broadhurst ..... A63B 21/0125 482/72
2016/0375297 A1 * 12/2016 Kiser ..... A63B 22/0087 482/73
2017/0136330 A1 * 5/2017 Stevens ..... A63B 69/004
2017/0182604 A1 * 6/2017 Velez ..... F16M 11/08
2018/0347726 A1 * 12/2018 Anderson ..... F16L 3/20

* cited by examiner

TRANSPORTABLE ROWING DEVICE

BACKGROUND

Rowing is a sport or activity where a rower uses an oar to propel a boat by pushing against water with the oar. Rowing is a common team and individual sport in some regions where members of a rowing team (a crew) race competing schools or teams. As with many other sports, members of the crew must practice to develop proper technique, skills, and strength to improve performance in competitions. However, rowing in small watercraft may not be convenient or cost-efficient for coaching and practicing.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Because rowing in small watercraft may not be ideal for coaching and practicing of techniques, it may be more convenient to practice rowing in a gym or other facility on land. However, indoor rowing machines using tanks of water are expensive and require a relatively large amount of space. There is therefore a need for a device that allows rowing technique to be practiced indoors without the use of an indoor water tank.

To address these and other problems, the inventor has developed a rowing apparatus that is configured to releasably secure an oar within an oar lock of the rowing device. The oar lock can be supported by a base that is mobile and/or transportable and that enables rotation of the oar lock with respect to the base. Such rotation allows a rower to operate an oar to practice techniques of their rowing stroke outside of water, which can save substantial cost for a practice facility and/or rower.

The above discussion is intended to provide an overview of subject matter of the present patent application. It is not intended to provide an exclusive or exhaustive explanation of the invention. The description below is included to provide further information about the present patent application.

Figure 1A:
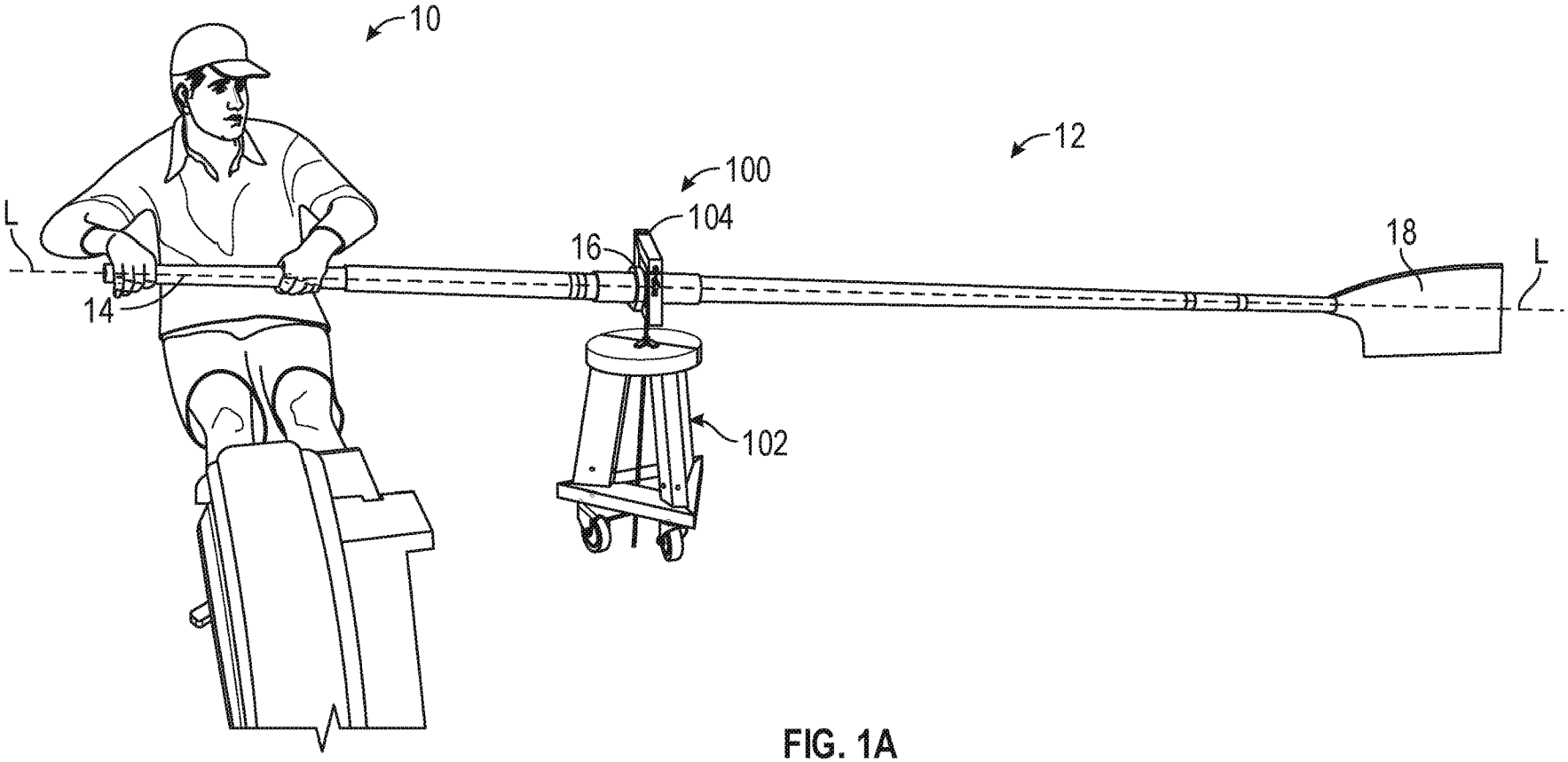
FIG. 1A illustrates a perspective view of a rowing device in a first condition, in accordance with at least one example of this disclosure.
Figure 1B:
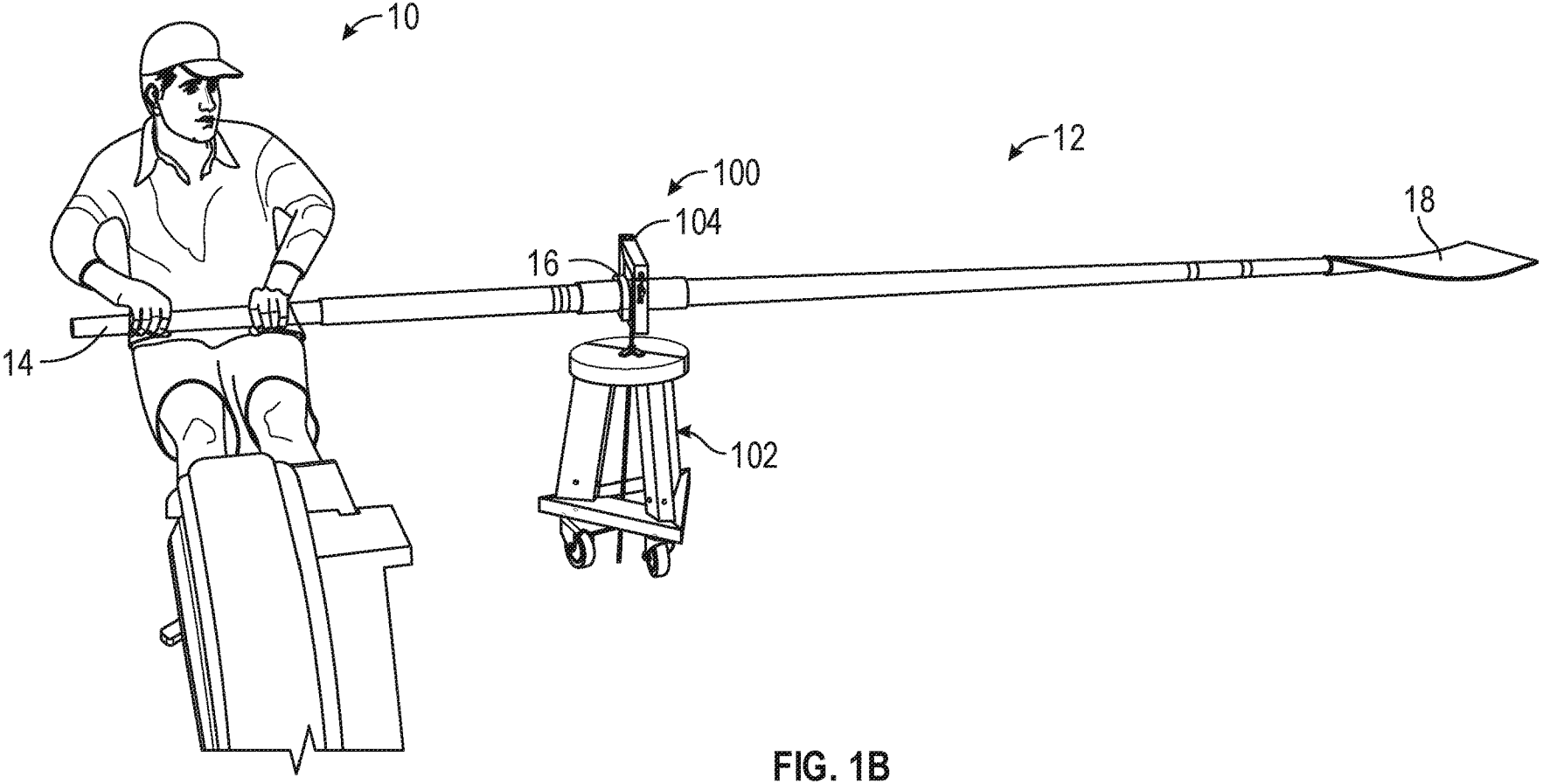
FIG. 1B illustrates a perspective view of a rowing device in a second condition, in accordance with at least one example of this disclosure.

FIG. 1A illustrates a perspective view of a rowing device 100 in a first condition, in accordance with at least one example of this disclosure. FIG. 1B illustrates a perspective view of the rowing device 100 in a second condition, in accordance with at least one example of this disclosure. FIGS. 1A and 1B are discussed below concurrently.

The rowing device 100 can include a base 102 and an oar lock 104. FIGS. 1A and 1B also show a rower 10 and an oar 12, which can include a handle 14, a collar 16, a blade 18, and a longitudinal axis L.

The rowing device 100 can be a device configured to releasably secure the oar 12 within the oar lock 104. The oar lock 104 can be supported by the base 102, which can rest on a floor or ground. As discussed in further detail below, the base 102 can include wheels and can generally be movable and transportable.

The oar lock 104 can be rotatable with respect to the base 102, allowing the rower 10 to complete a rowing stroke including a pull motion (shown in FIG. 1A) and a push motion (shown in FIG. 1B), while the oar lock 104 engages the collar 16 to limit movement of the oar 12 along the longitudinal axis L of the oar 12. Also, the oar lock 104 can allow the rower 10 to rotate the oar 12 about the longitudinal axis L while the oar 12 is secured within the oar lock 104, which allows the rower 10 to move the oar between a square position of the oar 12 (shown in FIG. 1A) and a feathered position of the oar 12 (shown in FIG. 1B). The combination of rotation of the oar 12 within the oar lock 104 and movement of the oar 12 during the stroke allows the rower 10 to complete a full oar stroke in most locations that the rowing device 100 can be positioned, allowing a rower to practice techniques of their rowing stroke outside of water, which can save substantial cost for a practice facility.

Though FIGS. 1A and 1B show the rower 10 using a sweep oar (oar 12) and a single rowing device 100, a second rowing device can be positioned opposite the rowing device 100 (on an opposite side of the rower 10) to accommodate sculling oars, allowing the rower 10 to practice a sculling stroke out of water.

Figure 2:
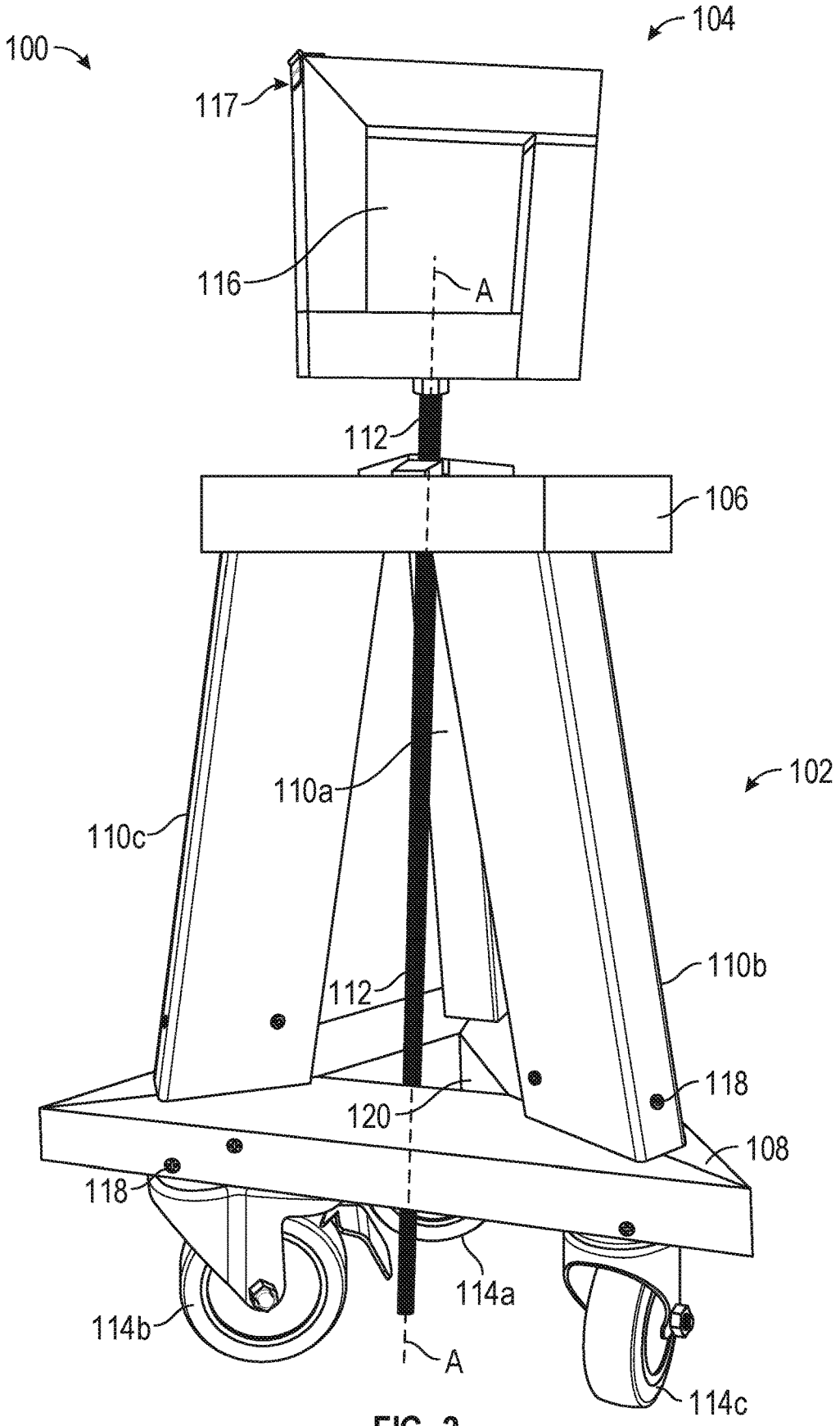
FIG. 2 illustrates a perspective view of a rowing device, in accordance with at least one example of this disclosure.

FIG. 2 illustrates a perspective view of the rowing device 100, in accordance with at least one example of this disclosure. The rowing device 100 can be consistent with the rowing device 100 of FIGS. 1A and 1B; FIG. 2 shows additional details of the rowing device.

For example, FIG. 2 shows that the base 102 can include a top plate 106, a base plate 108, frame members 110*a*-110*c*, rod 112, and wheels 114*a*-114*c*. FIG. 2 also shows that the oar lock 104 can include an opening 116 and a hinge 117. Also shown in FIG. 2 are fasteners 118, a longitudinal axis of the rod A, and orientation indicators Top and Bottom.

Each of the components of the rowing device 100 can be a rigid or semi-rigid body comprised of materials such as one or more of metals, plastics, foams, elastomers, ceramics, composites, combinations thereof, or the like. The top plate 106 can be a plate or assembly of pieces forming a top support with a bore extending therethrough where the bore is configured to support the rod 112. The bore can support a nut and/or can be threaded to create a threaded engagement between the top plate 106 and the rod 112 such that rotation of the rod 112 with respect to the top plate 106 about the axis A causes the rod 112 to translate along the axis A, moving the oar lock 104 therewith and allowing the rower 10 to select a height of the oar lock 104 by rotating the oar lock 104 with respect to the base 102.

Similarly, the base plate 108 can be a plate or assembly of pieces forming a bottom support with an opening 120 extending therethrough. The opening 120 is configured to allow the rod 112 to extend therethrough, which allows the rod 112 to be longer relative to the size of the base 102. This allows for a height of the oar lock 104 to have a greater range with respect to the ground or floor, providing more heights of the oar lock 104 for the rower 10 to choose from.

The frame members 110*a*-110*c* can be connected to the top plate 106 and the base plate 108 to limit relative movement of the top plate 106 and the base plate 108 and to generally support the top plate 106, rod 112, and oar lock 104 off the floor or ground. Though three frame members 110*a*-110*c* are shown, there can be fewer frame members, such as one or two, or more frame members such as 4, 5, 6, 7, 8, 9, 10, or the like.

In some examples, the top plate 106, base plate 108, and the frame members 110 can be made of a relatively strong and lightweight material, such as one or more of wood, aluminum, titanium, or the like, to help reduce an overall weight of the rowing device 100 to help increase portability thereof without compromising an overall strength or rigidity of the rowing device.

The rod 112 can be an elongate member extending along the longitudinal axis A of the rod. In some examples, the rod 112 can be a threaded rod. The rod 112 can be coupled to the top plate 106 and can extend through a rod bore of the top plate 106, such as through a threaded engagement with the top plate 106 enabling the rod 112 to be rotatable with respect to the top plate 106 and the base plate 108, as discussed above.

The oar lock 104 can be secured to a top portion of the rod 112 and can be configured to releasably secure the oar 12 therein. The oar lock 104 can be rotatable with the rod 112, as discussed above, and can open and close (as discussed below) and can be lockable (as further discussed below). The opening 116 of the oar lock 104 can be sized and shaped to receive the collar 16 of the oar 12 therein. In some examples the opening 116 can be substantially square; the opening 116 can be other shapes in other examples, such as a rectangle, a circle, an oval, or the like. The opening 116 can allow the oar 12 to be rotated between the feathered and square orientations (as shown in FIGS. 1A and 1B) while allowing the collar 16 to apply a force to the oar lock 104 such that the oar 12 can rotate the oar lock 104 with respect to the top plate 106 in either the feathered or square orientation.

The wheels 114*a*-114*c* can be wheels or casters secured to the base plate 108 and can be locking or non-locking wheels. The wheels 114 can allow for movement of the rowing device 100 on a floor or ground for relatively easy positioning of the rowing device 100. In some examples, the wheels 114 may not be included and the base plate 108 can rest on the floor or ground.

The hinge 117 can be a hinge connected to two adjacent members of a frame of the oar lock 104. The hinge 117 can be connected to such members to allow the oar lock 104 to open to receive the oar 12 and to close to secure the oar 12 therein. The hinge 117 is further discussed below with respect to FIGS. 6A and 6B The fasteners 118 can each be a fastener configured to secure to a component of the base 102 (such as a frame member) to another component (such as the top plate 106). The fasteners 118 can each be a screw, rivet, bolt, pin, adhesive, or the like, configured to secure two components.

In operation, a height of the oar lock 104 can be adjusted by rotating the oar lock 104 with respect to the top plate 106 until a desired height is reached. Then, the oar lock 104 can be unlatched (as discussed in FIGS. 6A and 6B) and the oar lock 104 can be opened (as also discussed in FIGS. 6A and 6B). The collar 16 of the oar 12 can then be inserted into the oar lock 104. The oar lock 104 can be closed and can be latched to secure the oar 12 in the oar lock 104.

The rower 10 can then row the oar 12 through an oar stroke, causing the oar lock 104 to rotate with respect to the base 102 via the rod 112 and its threaded connection with the top plate 106 and/or the nut connected thereto. While in the oar lock 104 (and during movement of the oar 12 through the stroke, if desired), the oar 12 can be rotated between the feathered and squared positions, as desired, and the oar 12 can apply a force to the oar lock 104 in either position to cause rotation of the oar lock 104 with respect to the base 102. When it is desired to remove the oar 12 from the oar lock 104, the oar lock 104 can be unlatched and can be moved to the open position to allow the oar 12 to be removed from, or repositioned in, the oar lock 104. Such a process can be repeated as desired, though opening and closing of the oar lock 104 is not required between strokes, as multiple strokes of the oar 12 can be performed while the oar 12 is secured within the oar lock 104. In this way, the rowing device 100 can allow the rower 10 to perform or practice a rowing stroke out of water.

Figure 3:
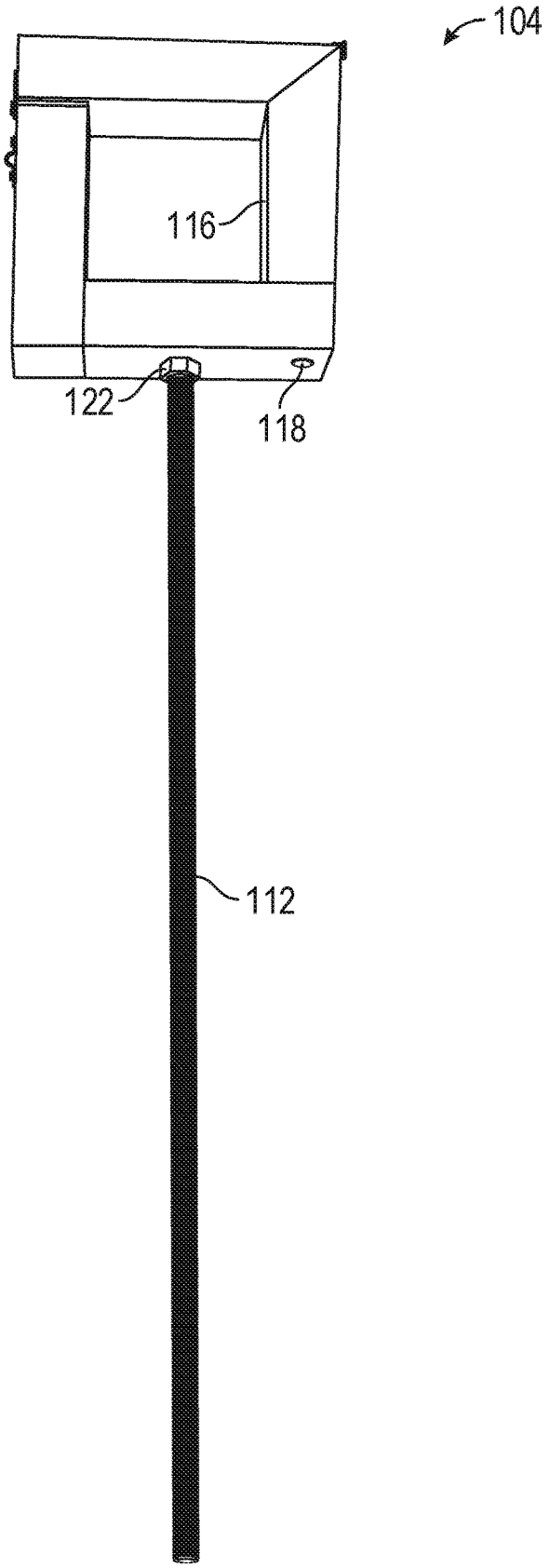
FIG. 3 illustrates a front view of a portion of a rowing device, in accordance with at least one example of this disclosure.

FIG. 3 illustrates a front view of the oar lock 104 and the rod 112 of the rowing device 100, in accordance with at least one example of this disclosure. The oar lock 104 and the rod 112 can be consistent with those discussed above with respect to FIGS. 1A-2; further details are shown and discussed with respect to FIG. 3. For example, FIG. 3 shows that the rod 112 can be connected to the oar lock 104 via a nut 122, which can allow the rod 112 to be replaceable. The nut 122 can be secured to the oar lock 104 such as via one or more of a press-fit configuration, adhesive, a threaded engagement, or the like.

Figure 4:
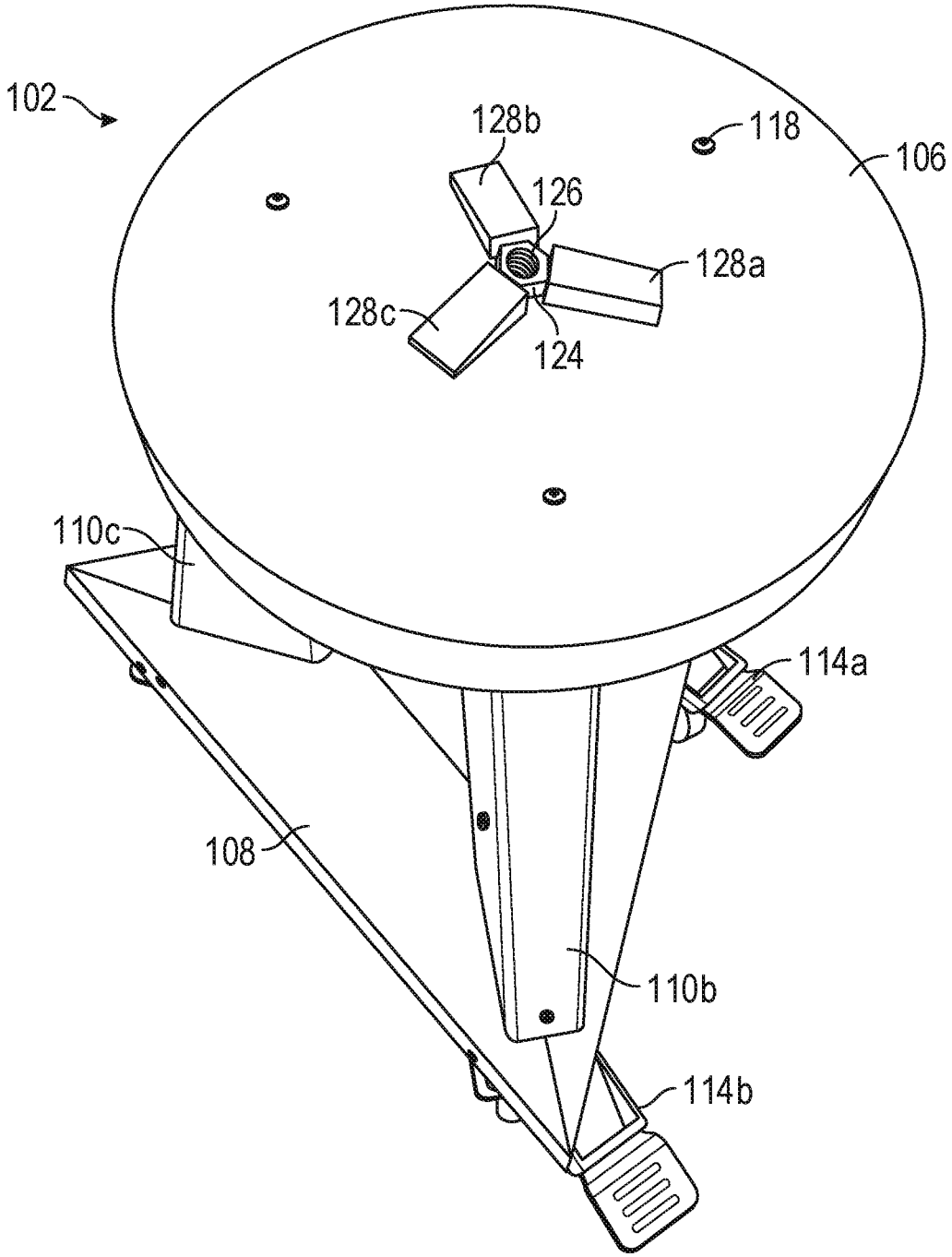
FIG. 4 illustrates a top view of a portion of a rowing device, in accordance with at least one example of this disclosure.

FIG. 4 illustrates a top view of a portion of the rowing device 100, in accordance with at least one example of this disclosure. The base 102 shown in FIG. 4 can be consistent with the base 102 discussed above with respect to FIGS. 1A-2; further details are shown and discussed with respect to FIG. 4.

For example, FIG. 4 shows a nut 126, which can be secured to the top plate 106 and can be configured to threadably engage with the rod 112 such that the rod 112 is rotatable within the nut to translate the rod 112 along the longitudinal axis A of the rod 112 to adjust a position of the oar lock 104 with respect to the top plate 106. The nut 126 can be secured within or adjacent to a bore 124 of the top plate 106 such as via one or more of a press-fit configuration, adhesive, a threaded engagement, or the like. In one example, the nut 126 can be further secured to the top plate 106 via retainers 128*a*-128*c*. Each retainer 128 can be connected to the top plate 106 and positioned thereon to abut the nut 126 to limit rotation of the nut 126 and to limit movement of the nut 126 with respect to the bore 124.

In some examples, the bore 124 can be threaded to threadably engage the rod 112, which can further help to guide and stabilize the rod 112. FIG. 4 also shows how fasteners 118 can be used to secure the top plate 106 to the frame members 110.

Figure 5:
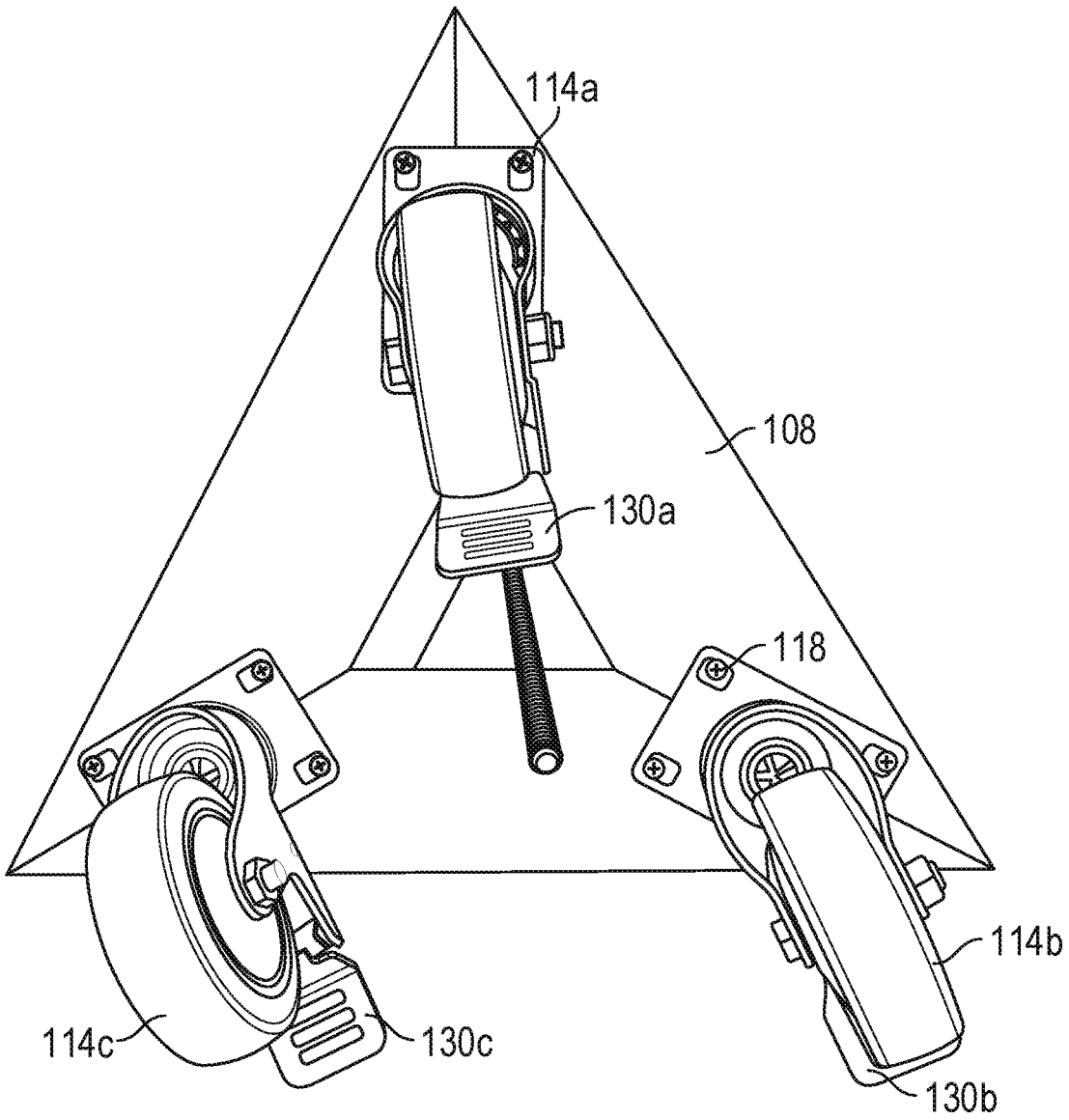
FIG. 5 illustrates a bottom view of a portion of a rowing device, in accordance with at least one example of this disclosure.

FIG. 5 illustrates a bottom view of a portion of the rowing device 100, in accordance with at least one example of this disclosure. The base plate 108 and wheels 114 shown in FIG. 5 can be consistent with the base plate 108 and wheels 114 discussed above with respect to FIGS. 1A-4; further details are shown and discussed with respect to FIG. 5.

For example, FIG. 5 shows that each of the wheels 114*a*-114*c* can be secured to a bottom portion of the base plate 108 using the fasteners 118. FIG. 5 also shows that the wheels 114*a*-114*c* can respectively include locks 130*a*-130*c*, which can be operated to lock the wheels 114 to limit undesired movement of the base 102 during use of the rowing device 100.

Figure 6A:
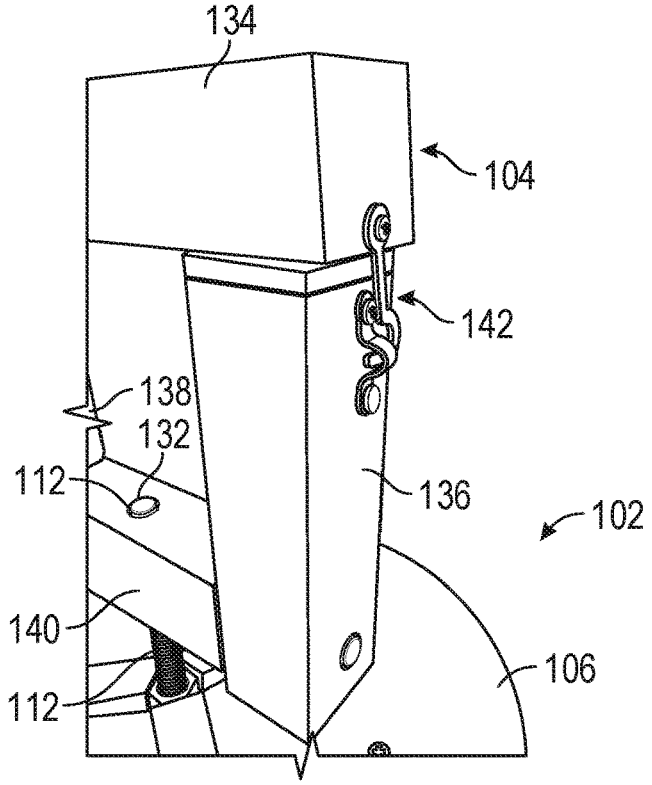
FIG. 6A illustrates a perspective view of a portion of a rowing device in a first condition, in accordance with at least one example of this disclosure.
Figure 6B:
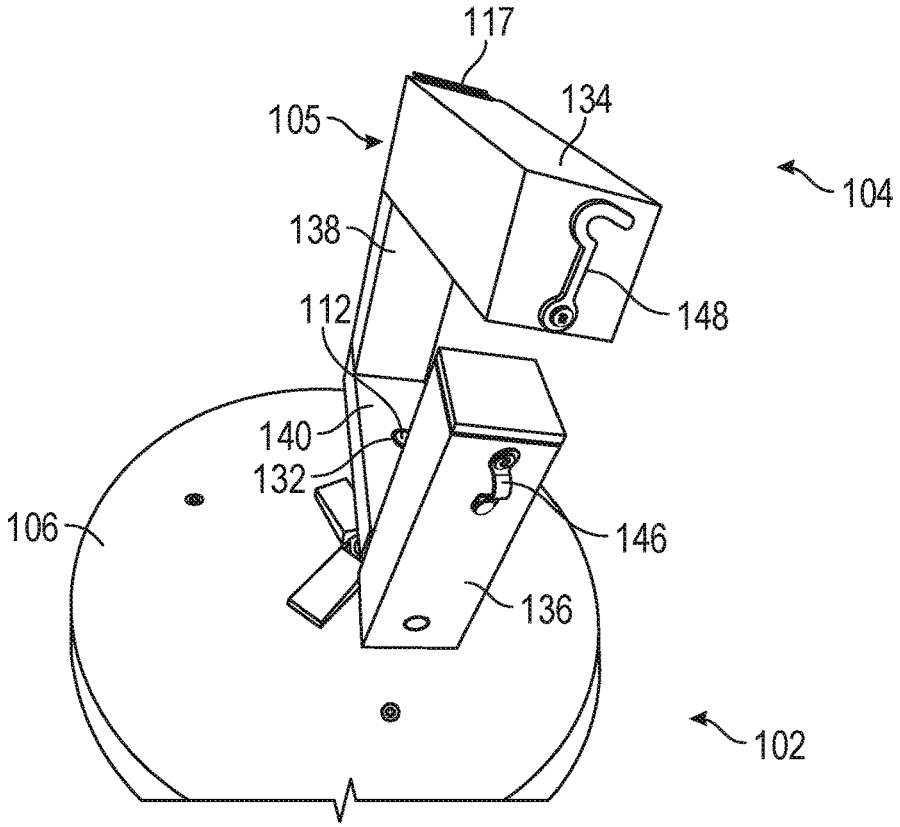
FIG. 6B illustrates a perspective view of a portion of a rowing device in a second condition, in accordance with at least one example of this disclosure.

FIG. 6A illustrates a perspective view of a portion of the rowing device 100 in a first condition, in accordance with at least one example of this disclosure. FIG. 6B illustrates a perspective view of a portion of the rowing device 100 in a second condition, in accordance with at least one example of this disclosure. FIGS. 6A and 6B are discussed below concurrently.

The oar lock 104 shown in FIGS. 6A and 6B can be consistent with the oar lock 104 discussed above with respect to FIGS. 1A-4; further details are shown and discussed with respect to FIGS. 6A-6B. For example, the oar lock 104 can include a frame 105. The frame 105 can include a frame bore 132, a top member 134, side members 136 and 138, and a bottom member 140.

The frame bore 132 can extend through the bottom member 140 and can be configured to receive the rod 112 therein. In some examples, the frame bore 132 can be threaded. The top member 134 can be connected to each of the side members 136 and 138. Each of the side members 136 and 138 can be connected to the bottom member 140 to, together with the top member 134, form the opening 116 of the oar lock 104. The top 134 member can be connected to the side member 138 via the hinge 117, which can allow the top member 134 to pivot or rotate with respect to the side member 138 between an open position, shown in FIG. 6A, and a closed position, shown in FIG. 6B, FIGS. 6A and 6B also show a latch 142, which can include a hook 148 and a catch 146. The catch 146 is shown as being connected to the side member 136 and the hook 148 is shown as being connected to the top member 134; the hook 148 and catch 146 can each be connected to any of the members of the frame 105. In operation, the hook 148 can engage the catch 146 to lock the oar lock 104 when the top member 134 is in the closed position, limiting movement of the top member 134 with respect to the side members 136 and 138. The hook 148 can be removed from the catch 146 to unlock the latch 142, which can allow the top member 134 to pivot about the hinge 117. As discussed above, the oar lock 104 can allow the collar 16 of the oar 12 to rotate within the oar lock 104 when the oar lock 104 is locked, and the oar lock 104 can contact the collar 16 to limit movement of the oar 12 along the longitudinal axis L (shown in FIGS. 1A and 1B) of the oar 12.

Figure 7:
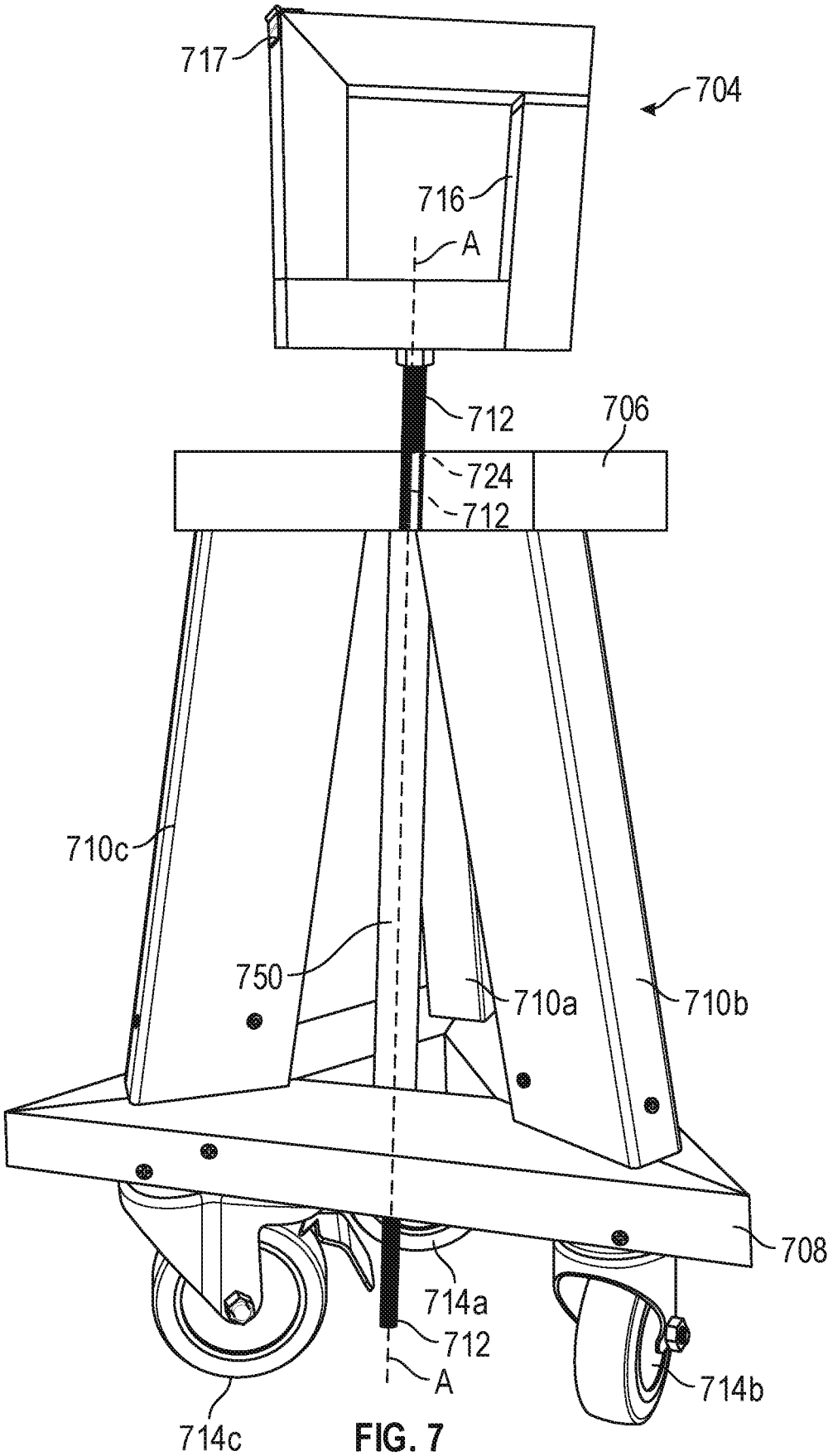
FIG. 7 illustrates a perspective view of a rowing device, in accordance with at least one example of this disclosure.

FIG. 7 illustrates a perspective view of a rowing device 700, in accordance with at least one example of this disclosure. The rowing device 700 can include a rod guide 750 secured to the top plate 706 and/or the bottom support 708 to help guide the rod 712. Any of the previously discussed rowing devices can be modified to include the rod guide 750.

The rod guide 750 can be connected to one or more of the top plate 706 and the bottom support 708 and can at least partially surround the rod 712 to limit non-axial movement of the rod 712 with respect to the top plate 706 and the bottom support 708 during rowing (i.e., rotation of the oar lock 704). FIG. 7 also shows how a rod bore 724 can extend through the top plate 706 and can be threaded to engage the rod 712.

NOTES AND EXAMPLES

The following, non-limiting examples detail certain aspects of the present subject matter to solve challenges and provide benefits discussed herein, among others.

Example 1 is a transportable rowing device comprising: a top plate including a rod bore extending therethrough; a base plate; a frame member connected to the top plate and the base plate; a rod coupled to the top plate and extending through the rod bore along a longitudinal axis of the rod, the rod rotatable with respect to the top plate and the base plate; and an oar lock secured to the rod and configured to releasably secure an oar therein, the oar lock rotatable with the rod.

In Example 2, the subject matter of Example 1 optionally includes a nut secured to the top plate and configured to threadably engage the rod such that the rod is rotatable within the nut to translate the rod along the longitudinal axis of the rod to adjust a position of the oar lock with respect to the top plate.

In Example 3, the subject matter of Example 2 optionally includes wherein the rod is a threaded rod.

In Example 4, the subject matter of any one or more of Examples 2-3 optionally include wherein the oar lock comprises a frame having a substantially square opening configured to receive and retain a collar of the oar therein and configured to allow rotation of the collar within the oar lock when the oar lock is locked.

In Example 5, the subject matter of Example 4 optionally includes wherein: the frame further comprises a top member, a first side member, and a second side member opposing the first side member; and the oar lock comprises a hinge connected to the first side member and the top member to allow the top member to rotate with respect to the first side member of the frame when the oar lock is unlocked.

In Example 6, the subject matter of Example 5 optionally includes wherein the oar lock comprises a latch connected to the second side member of the oar lock and connected to the top member of the oar lock, the latch operable to lock and unlock the oar lock.

In Example 7, the subject matter of any one or more of Examples 4-6 optionally include wherein the oar lock allows the collar of the oar to rotate within the oar lock when the oar lock is locked and contacts the collar to limit movement of the oar along a longitudinal axis of the oar.

In Example 8, the subject matter of any one or more of Examples 1-7 optionally include a second support and a third support each connected to the top plate and the base plate.

In Example 9, the subject matter of any one or more of Examples 1-8 optionally include a plurality of wheels connected to an underside of the base plate, the wheels lockable to limit movement of the transportable rowing device with respect to a ground when an oar is operated to rotate the oar lock.

In Example 10, the subject matter of any one or more of Examples 1-9 optionally include wherein the rod bore is threaded to threadably engage the rod.

In Example 11, the subject matter of any one or more of Examples 1-10 optionally include a rod guide connected to one or more of the top plate and the base plate and at least partially surrounding the rod to limit non-axial movement of the rod with respect to the top plate and the base plate.

Example 12 is a transportable rowing device comprising: a top plate including a rod bore extending therethrough; a base plate; a frame member connected to the top plate and the base plate; a rod coupled to the top plate and extending through the rod bore along a longitudinal axis of the rod, the rod rotatable with respect to the top plate and the base plate; and an oar lock secured to the rod and comprising a frame having a substantially square opening configured to receive and releasable secure a collar of an oar therein, the oar lock rotatable with the rod.

In Example 13, the subject matter of Example 12 optionally includes wherein the frame of the oar lock engages the collar to allow rotation of the collar within the oar lock when the oar lock is locked.

In Example 14, the subject matter of Example 13 optionally includes wherein: the frame further comprises a top member, a first side member, and a second side member opposing the first side member; and the oar lock comprises a hinge connected to the first side member and the top member to allow the top member to rotate with respect to the first side member of the frame when the oar lock is unlocked.

In Example 15, the subject matter of Example 14 optionally includes wherein the oar lock comprises a latch connected to the second side member of the oar lock and connected to the top member of the oar lock, the latch operable to lock and unlock the oar lock.

In Example 16, the subject matter of any one or more of Examples 13-15 optionally include wherein the oar lock allows the collar of the oar to rotate within the oar lock when the oar lock is locked and contacts the collar to limit movement of the oar along a longitudinal axis of the oar.

In Example 17, the subject matter of any one or more of Examples 12-16 optionally include a second support and a third support each connected to the top plate and the base plate.

In Example 18, the subject matter of any one or more of Examples 12-17 optionally include a plurality of wheels connected to an underside of the base plate, the wheels lockable to limit movement of the transportable rowing device with respect to a ground when an oar is operated to rotate the oar lock.

In Example 19, the subject matter of any one or more of Examples 12-18 optionally include wherein the rod bore is threaded to threadably engage the rod.

Example 20 is a transportable rowing device comprising: a top plate; a base plate; a frame member connected to the top plate and the base plate; a rod coupled to one or more of the top plate and the base plate, the rod rotatable with respect to the top plate and the base plate; and an oar lock secured to the rod and configured to secure an oar therein, the oar lock rotatable with the rod In Example 21, the apparatuses or method of any one or any combination of Examples 1-22 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A transportable rowing device comprising:

a top plate including a rod bore extending therethrough;

a base plate;

a frame member connected to the top plate and the base plate;

a rod coupled to the top plate and extending through the rod bore along a longitudinal axis of the rod, the rod rotatable with respect to the top plate and the base plate;

an oar lock secured to the rod and configured to releasably secure an oar therein, the oar lock rotatable with the rod, the oar lock comprising:

a frame having a substantially square opening configured to receive and retain a collar of the oar therein and configured to allow rotation of the collar within and with respect to the oar lock when the oar lock is locked. the frame including a top member, a first side member, and a second side member opposing the first side member; and a hinge connected to the first side member and the top member to allow the top member to rotate with respect to the first side member of the frame when the, oar lock is unlocked: and a nut secured to the top plate and configured to threadably engage the rod such that the rod is rotatable within the nut to translate the rod along the longitudinal axis of the rod to adjust a position of the oar lock with respect to the top plate.

2. The transportable rowing device of claim 1, wherein the rod is a threaded rod.

3. The transportable rowing device of claim 1, wherein the oar lock comprises a latch connected to the second side member of the oar lock and connected to the top member of the oar lock, the latch operable to lock and unlock the oar lock.

4. The transportable rowing device of claim 1, wherein the oar lock allows the collar of the oar to rotate within the oar loch when the oar lock is locked and contacts the collar to limit movement of the oar along a longitudinal axis of the oar.

5. The transportable rowing device of claim 1, further comprising:

a second frame member and a third each connected to the top plate and the base plate, wherein the frame member is a first frame member.

6. The transportable rowing device of claim 1, further comprising:

a plurality of wheels connected to an underside of the base plate, the wheels lockable to limit movement of the transportable rowing device with respect to a ground when the oar is operated to rotate the oar lock.

7. The transportable rowing device of claim 1, wherein the rod bore is threaded to threadably engage the rod.

8. The transportable rowing device of claim 1, further comprising:

a rod guide connected to one or more of the top plate and the base plate and at least partially surrounding the rod to limit non-axial movement of the rod with respect to the top plate and the base plate.

9. A transportable rowing device comprising:

a top plate including a rod bore extending therethrough;

a base plate;

a frame member connected to the top plate and the base plate;

a rod coupled to the top plate and extending through the rod bore along a longitudinal axis of the rod, the rod rotatable with respect to the top plate and the base plate; and an oar lock secured to the rod and comprising a frame having a substantially square opening configured to receive and releasably secure a collar of an oar therein, the oar lock rotatable with the rod, and the frame of the oar lock configured to engage the collar to allow rotation of the collar within and with respect to the oar lock when the oar lock is locked;

wherein the frame further comprises a top member a first side member, and a second side member opposing the first side member; and wherein the oar lock comprises a hinge connected to the first side member and the top member to allow the top member to rotate with respect to the first side member of the frame when the oar lock is unlocked.

10. The transportable rowing device of claim 9, wherein the oar lock comprises a latch connected to the second side member of the oar lock and connected to the top member of the oar lock, the latch operable to lock and unlock the oar lock.

11. The transportable rowing device of claim 9, wherein the oar lock allows the collar of the oar to rotate within the oar lock when the oar lock is locked and contacts the collar to limit movement of the oar along a longitudinal axis of the oar.

12. The transportable rowing device of claim 9, further comprising:

a second frame member and a third frame member each connected to the top plate and the base plate, wherein the frame member is a first frame member.

13. The transportable rowing device of claim 9, further comprising:

a plurality of wheels connected to an underside of the base plate, the wheels lockable to limit movement of the transportable rowing device with respect to a ground when the oar is operated to rotate the oar lock.

14. The transportable rowing device of claim 9, wherein the rod bore is threaded to threadably engage the rod.

* * * * *